United States Patent [19]

Tohma et al.

[11] Patent Number: 4,960,632

[45] Date of Patent: Oct. 2, 1990

[54] THERMAL TRANSFER MATERIAL

[75] Inventors: Koichi Tohma, Kawasaki; Tetsuo Hasegawa, Tokyo; Naoki Kushida, Yokohama; Yasuyuki Tamura, Yokohama; Hisao Yaegashi, Yokohama; Takayuki Suzuki, Saitama, all of Japan

[73] Assignee: Canon Kabushiki Kaisha, Tokyo, Japan

[21] Appl. No.: 98,320

[22] Filed: Sep. 18, 1987

[30] Foreign Application Priority Data

Sep. 24, 1986 [JP] Japan ..... 61-226823

[51] Int. Cl.[5] ..... B41M 5/26

[52] U.S. Cl. ..... 428/212; 428/195; 428/336; 428/484; 428/488.1; 428/488.4; 428/913; 428/914

[58] Field of Search ..... 428/195, 207, 211, 212, 428/484, 488.1, 488.4, 913, 914, 336

[56] References Cited

U.S. PATENT DOCUMENTS 4,681,796 7/1987 Maehashi et al. ..... 428/212
4,880,686 11/1989 Yaegashi et al. ..... 428/212

FOREIGN PATENT DOCUMENTS 0208385 1/1987 European Pat. Off. .
3507097 9/1985 Fed. Rep. of Germany .
137789 6/1986 Japan .

*Primary Examiner*—Pamela R. Schwartz
*Attorney, Agent, or Firm*—Fitzpatrick, Cella, Harper & Scinto

[57] ABSTRACT

A thermal transfer material suitable for two-color recording comprises a support and at least a first ink layer and a second ink layer disposed in this order on the support. The adhesion strength $F_1$ between the support and the first ink layer and the adhesive strength $F_2$ between the first and second ink layers satisfy the relations of $F_1 > F_2$ at a higher temperature and $F_1 < F_2$ at a lower temperature. The total ink layers on the support having a tensile strength of 8–20 kg/cm$^2$. Two color recording is effected by superposing the thermal transfer material on plain paper, applying a pattern of heat and separating the thermal transfer material from the paper while changing the time from heating until the separation, i.e., temperatures at the time of separation. Sharp edge cutting of the heated portion is ensured by the definition of the tensile strength.

7 Claims, 3 Drawing Sheets

THERMAL TRANSFER MATERIAL

FIELD OF THE INVENTION AND RELATED ART

The present invention relates to a thermal transfer material for use in a recording method of transferring two-color images onto a recording medium such as plain paper.

The thermal or heat-sensitive transfer recording method has recently been widely used because it has general advantages of the thermal recording method such that the apparatus employed is light in weight, compact, free of noise, excellent in operability and adapted to easy maintenance, and also has other advantages such that it does not require a color-formation type converted paper but provides recorded images with excellent durability.

Further, there is also a commercial demand for a method of obtaining two-color images while retaining the advantages of the thermal transfer recording method as described above. Accordingly, there have been proposed several techniques for obtaining two-color images.

In order to obtain two-color images on plain paper by the thermal transfer recording method, Japanese Laid-Open Pat. Application No. 148591/1981 discloses a two-color type thermal transfer recording element (transfer material) comprising a substrate and two heat-fusible ink layers including a high-melting point ink layer A and a low-melting point ink layer B containing mutually different colorants disposed in this order on the substrate. When a low thermal input energy is applied to the element, only the low-melting point layer B is transferred onto plain paper. On the other hand, when a high thermal input energy is applied to the element, both the heat-fusible ink layers A and B are transferred onto the plain paper. As a result, two-color images can be obtained.

Further, Japanese Laid-Open Pat. Application No. 64389/1984 discloses a two-color thermal transfer ink sheet which comprises, on a substrate, an ink layer comprising an ink which melt-exudes at a lower temperature and another ink which is melt-peeled at a higher temperature than the melt-exudation temperature.

In the methods using the above mentioned thermal transfer materials, two-color recording is effected by changing the energy applied to a thermal head at two levels so as to change the temperature of the ink layers. However, when a high energy is supplied to the ink layers to provide a high temperature, a lower temperature portion is formed at the periphery of a higher temperature portion due to heat diffusion, so that a bordering of a lower temperature color is formed around the higher temperature printed image. Further, when a high energy is supplied to a thermal head, it requires a relatively long time until the thermal head is cooled so that a higher-temperature printed image is liable to be accompanied with a trailing of a lower-temperature color. Further, in any of the above methods, there is a constraint that a relatively low melting material is required for providing an ink to be transferred at a lower temperature, whereby they give rise to problems such as ground soiling and low storability of the thermal transfer material.

As a technique for dissolving the above-mentioned problems, our research group has proposed a recording method as disclosed in Japanese Laid-Open Pat. Application No. 137789/1986 (U.S. Pat. Application Ser. No. 819,497). In this recording method, there is employed a thermal transfer material comprising a support and at least a first ink layer and a second ink layer disposed in this order on the support, and after heat is applied to the thermal transfer material, a length of time from the heat application until the separation between the transfer material and a recording medium is so controlled that the second ink layer is selectively, or both the first and second ink layers are, transferred to the recording medium.

Our research group has further proposed, as a thermal transfer material for use in such recording method, one as disclosed in Japanese Laid-Open Pat. Application No. 295075/1986 and one as disclosed in Japanese Laid-Open Pat. Application No. 295079/1986. Japanese Laid-Open Pat. Application No. 295075/1986 discloses a thermal transfer material wherein at least one of a first ink layer and a second ink layer contains a silicone oil or a fluorine-containing surfactant so as to promote separation between the first and second ink layers. Japanese Laid-Open Pat. Application No. 295079/1986 discloses a thermal transfer material wherein a fine powder layer not meltable under application of a heat energy for recording is disposed between a first ink layer and a second ink layer so as to easily cause separation therebetween.

The above-mentioned recording method disclosed in Japanese Laid-Open Pat. Application No. 137789/1986 (U.S. Pat. Application Ser. No. 819,497), has solved the problems of bordering, trailing, etc., in the prior art. In this new two-color recording method, however, a further improvement in transferred image quality is still desired.

In order to obviate a problem that the first ink is mixed into an image of the second ink when the second ink layer is selectively transferred in the above recording method, our research group has also proposed to separate the thermal transfer material from a recording medium under the action of a peeling force of not less than 20 g-f (gram-force) and less than 200 g-f in a direction perpendicular to and leaving from the surface of the recording medium toward the thermal transfer material (U.S. Pat. Application Ser. No. 58,852).

The quality of a recorded image is also improved by promoting sharp edge-cutting of a transferred image. It is, however, not always easy to effect such sharp edge-cutting in a transfer operation because it is influenced by various actual recording conditions such as a heat-application condition and a peeling condition among others.

SUMMARY OF THE INVENTION

A general object of the present invention is to solve the above-mentioned problems involved in the conventional two-color image recording methods.

A principal object of the present invention is to provide a thermal transfer material by which clear recorded images with sharp edges can be formed on plain paper, especially when applied to our two-color image recording methods as described above.

As a result of further study of ours, it has been found critical for the ink layers including the first and second layers to satisfy a certain range of tensile strength as a material for providing transferred images with good quality in the above-described recording methods of ours.

According to the present invention, there is provided a thermal transfer material, comprising: a support and at least a first ink layer and a second ink layer disposed in the order named on the support, wherein the adhesion strength $F_1$ between the support and the first ink layer and the adhesion strength $F_2$ between the first and second ink layers satisfy the relations of $F_1 > F_2$ at a higher temperature and $F_1 < F_2$ at a lower temperature, and the total ink layers on the support have a tensile strength in the range of 8–20 kg/cm$^2$.

These and other objects, features and advantages of the present invention will become more apparent upon a consideration of the following description of the preferred embodiments of the present invention taken in conjunction with the accompanying drawings, wherein like parts are denoted by like reference numerals. In the description appearing hereinafter, "part(s)" and "%" used for describing quantities are by weight unless otherwise noted specifically.

DETAILED DESCRIPTION OF THE INVENTION

Figure 1:
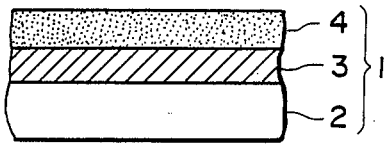
FIG. 1 is a schematic sectional view across the thickness of an embodiment of the thermal transfer material according to the present invention.

Referring to FIG. 1, a thermal transfer material 1 according to the present invention comprises a support 2, and a first ink layer 3 and a second ink layer 4 disposed in this order on the support.

In the thermal transfer material of the present invention, it is essential that the adhesion (strength) $F_2$ between the first ink layer 3 and the second ink layer 4 and the adhesion (strength) $F_1$ between the first ink layer 3 and the support 2 satisfy the relations of $F_1 > F_2$ at a higher temperature and $F_1 < F_2$ at a lower temperature. By establishing the relative adhesions as described, the thermal transfer material is constructed so as to be adapted to two-color image recording. Thus, when the transfer material is supplied with heat, the separation between the first ink layer 3 and the second ink layer 4 is more readily caused than that between the first ink layer 3 and the support 2 immediately after the heating. On the other hand, the separation between the first ink layer 3 and the support 21 becomes relatively easier after a considerable time has passed from the heating until the separation of the support 2 from a recording medium, i.e., at the time when the transfer material 1 is cooled after the transfer material 1 and the recording medium has been superposed, heated and retained for a substantial time after heating and before peeling.

The above mentioned characteristics of the respective layers will be further explained with reference to FIG. 2A.

Incidentally, the adhesion ($F_2$) between the second and first ink layers and the adhesion ($F_1$) between the first ink layer and the support are evaluated according to relative easiness between the separation between the second and first ink layers, and the separation between the first ink layer and the support, when transfer recording is effected on a recording medium. Such evaluation of the adhesions is not affected by the form of separation between ink layers (e.g., whether or not the separation between the second and first ink layers has occurred strictly at the boundary between these layers, or whether or not some adhesive layer described hereinafter, if any, remains on the thermal transfer material).

Figure 2A:
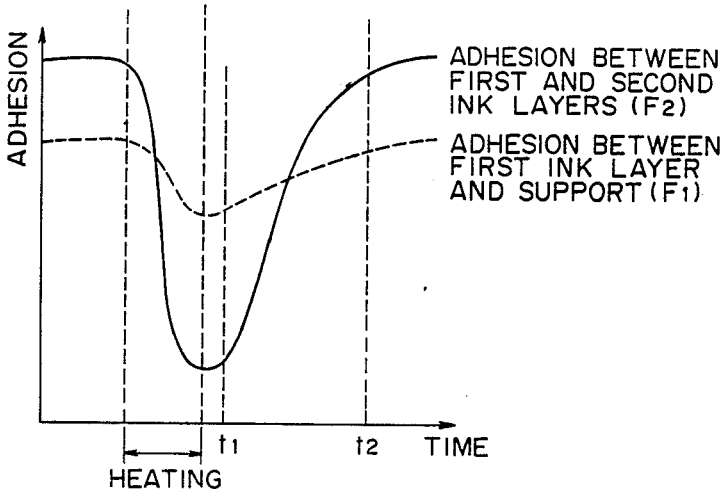
FIGS. 2A and 2B are graphs each showing a variation in adhesion strength between various layers with elapse of time.

Now, referring to FIG. 2A, the adhesion ($F_2$) between the first ink layer 3 and the second ink layer 4, and the adhesion ($F_1$) between the first ink layer 3 and the support 2, change on heating and cooling. In the embodiment shown in FIG. 1, the second ink layer 4 in FIG. 1 is composed of a material showing a large change in adhesion or cohesion so that the adhesion $F_2$ sharply decreases on temperature increase due to heating by a thermal head. As a result, the adhesion $F_2$ between the first ink layer 3 and the second ink layer 4 is weaker than the adhesion $F_1$ between the first ink layer 3 and the support 2 as shown in FIG. 2A, at a time immediately after heating (i.e., before the temperature being lowered). Accordingly, if the transfer material is peeled from the recording medium immediately after the transfer material is heated while the second ink layer 4 thereof being in contact with the recording medium, i.e., at a time $t_1$ in FIG. 2A, only the second ink layer 4 is transferred to the recording medium.

In contrast, if the transfer material is peeled from the recording medium at a time $t_2$ in FIG. 2 when a little time has passed after heating (i.e., the temperature of the ink layer has been lowered) and the adhesion $F_2$ is recovered to exceed the adhesion $F_1$, the first ink layer 3 is transferred together with the second ink layer 4 to the recording medium.

Accordingly, if the first ink layer 3 and the second ink layer 4 are composed to have different color tones from each other in the thermal transfer material, two-color recording can be effected by using the thermal transfer material of the present invention. When the color of the first ink layer 3 and the second ink layer 4 are desired to be obtained substantially as they are, it is preferred to dispose a first ink layer 3 of a dark color such as black and a second ink layer 4 of a brighter color than that of the first ink layer such as red. Further, the first and second ink layers can be made in the same hue but different in density from each other, whereby two-color images with dense and pale portions can be obtained in the same manner as described above. Further, the first ink layer can function as a correcting ink layer by incorporating, e.g., a white pigment having a strong hiding power therein.

Figure 2B:
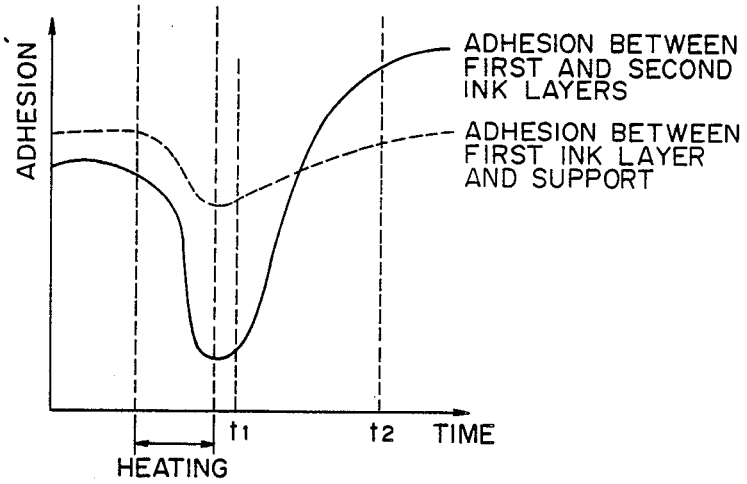

In the above embodiments explained with reference to FIG. 2A, the relative adhesions between the layers after a substantial time after heating are essentially the same as those before heating. This is, however, not an essential requirement. For example, as shown in FIG. 2B, it is possible that the relative adhesions between the layers are not inverted in the course of heating but are inverted in the course of cooling after heating. More specifically, in a case where the ink layers are formed by emulsion-coating, the states of the ink layers after a little while after heating can be different from those of the ink layers before heating. Further, the separation between the first ink layer 3 and the support 2 need not necessarily occur at the boundary between them but may occur within the first ink layer 3.

More specifically, the above-mentioned relations between the adhesions $F_1$ and $F_2$ at higher and lower temperatures can be confirmed in the following manner, for example.

A thermal transfer material 1 as shown in FIG. 1 is superposed on a recording medium such as plain paper, e.g., one having a Bekk smoothness of 200 sec so that the second ink layer 4 of the transfer material 1 contacts the recording medium, and heat is applied in a pattern (e.g., solid print pattern) to the transfer material 1 from its support 2 side by means of a thermal head as in the ordinary thermal transfer recording method. After the heat application, the transfer material 1 and the plain paper are, as they are without peeling, loaded on a tensile strength tester (Tensilon RTM-100, Toyo Boldwin K.K.) provided with a thermostat chamber capable of temperature control in the range of −60° C. to +270° C. so as to allow peeling at a peeling angle of 180 degrees. By using the above tester, the transfer material 1 and the plain paper are peeled from each other at a peeling speed of 300 mm/sec at various environmental temperatures (temperatures in the thermostat chamber). When the environmental temperature is a higher temperature, e.g., 90° C., the second ink layer 4 is selectively transferred to the plain paper as a recording medium (confirmation of $F_1 > F_2$, FIG. 3A). On the other hand, the environmental temperature is a lower temperature, e.g., 40° C., both the first ink layer 3 and the second ink layer 4 are transferred (confirmation of $F_1 < F_2$, FIG. 3B). In this instance, when the first and second ink layers are caused to contain colorants of different color tones, an image with the color of the second ink is obtained at the environmental temperature of 90° C. and an image with the color the first ink is obtained at the environmental temperature of 40° C. In this way, the above-mentioned relations between the adhesions $F_1$ and $F_2$ can be easily confirmed.

Now, in order to obtain clear recorded images with sharply cut edges, it is desired that there is formed a clear boundary between a heat-applied portion and a non-heat-applied portion in an ink layer. Herein, clear edge cutting refers to that an ink layer supplied with heat is clearly cut at a boundary between a heat-applied portion and a non-heat-applied portion.

However, when the transfer material is peeled from the recording medium after a relatively long period, i.e., when the transfer material is peeled from the recording medium at time $t_2$ in FIG. 2A or 2B, to transfer both the first and second ink layers to the recording medium, the heated ink layer is lowered in temperature so that the cohesion in the ink layers approaches to that before the heating. For this reason, if the ink layers has a large tensile strength, edges of the images cannot be sharply cut, thus failing to provide clear recorded images, as the temperature of the ink layers is lowered.

Further, in a heated portion of the ink layers, there is formed a temperature distribution in the thickness-wise direction and in a direction perpendicular thereto such that the central part of the heated portion is higher in temperature than a peripheral part thereof. This tendency becomes noticeable with distance from the thermal head. For this reason, the adhesion strength between the ink layers and the recording medium is larger at the central part and becomes smaller toward the peripheral parts of the heated portion. In this instance, if the tensile strength of the ink layers is large, the adhesion with the recording medium cannot exceed the cohesion in the ink layers at the periphery of the heated portion, so that some part of ink is not transferred but remains on the support undesirably. As a result, the recorded image becomes thinner than the heat application pattern and thus provides a very poor appearance. On the contrary, if the tensile strength of the ink layers is originally lowered to some extent than in an ordinary thermal transfer material, the adhesion at the periphery exceeds the cohesion of the ink layers thereat to provide sharply cut edges at the boundary between the heated and non-heated portions without causing thinning of the recorded images even if the temperature of the ink layers is lowered.

Thus, in the thermal transfer material according to the present invention, all the ink layers (hereinafter inclusively referred to as "total ink layer") including the first and second ink layers and an adhesive, if any, on the support, as a whole, has a tensile strength of 8–20 kg/cm$^2$, preferably 11–19 kg/cm$^2$ so as to improve edge cutting when both the first and second ink layers are transferred.

If the tensile strength of the total ink layer exceeds 20 kg/cm$^2$, the ink layer has too high a strength, so that the heated portion and non-heated portion cannot be cut with a clear boundary, thus failing to provide a clear recorded image. On the other hand, if the tensile strength is below 8 kg/cm$^2$, the ink layer has too low a strength, so that the ink layer is liable to be cut too readily, thus causing lacking of images. More specifically, the surface of the recording medium such as paper is generally not smooth but uneven. Therefore, when a thermal transfer material and a recording medium are superposed some concave parts on the recording medium do not contact the ink layer. If the transfer material is peeled from the recording medium under such a state, an ink portion not contacting the recording medium is pulled toward the support because of the adhesion with the support, and an ink portion contacting the recording medium is pulled toward the recording medium because of the adhesion with the recording medium. If the tensile strength of the ink layer is too low at this time, the ink layer can be cut at the boundary between the portion contacting the recording medium and the portion not contacting the recording medium, so that the portion contacting the recording medium is transferred to the recording medium whereas the portion not contacting the recording medium remains on the support. As a result, lacking of the recorded image occurs.

For the purpose of obtaining clear recorded images with sharply cut edges, it is sufficient that the total ink layer has a tensile strength in the range of 8–20 kg/cm$^2$, and it is not necessary for an individual of the first ink layer, the second ink layer or the adhesive layer, if any, to have a tensile strength in the above-mentioned range.

Incidentally, the thermal transfer material according to the present invention provides particularly excellent recorded images when it has a thickness of the total ink layer in the range of 2–10 μm and is used to provide a unit image width (width of a recorded unit image measured in the transverse direction of the transfer material) of 0.4 cm or smaller.

The tensile strength used herein is based on values measured by using a sample in the form of a flat dumbbell and using a tensile tester (Tensilon RTM-100, mfd. by Toyo Boldwin K.K.) at a pulling speed of 300 mm/sec and refers to a yield strength (kg/cm$^2$) based on the measured data.

A flat dumbbell sample is prepared in the following manner. Inks constituting the respective ink layers in a thermal transfer material are respectively and separately applied on a release paper by means of an applicator or wire bar and dried to form individual ink layers each having a thickness of about 50 μm (to be controlled in the range of 40–60 μm). After the drying, the release paper is removed to obtain ink layer samples. After the sample preparation, the thickness of each sample is accurately measured by means of a contact-type thickness gauge (supplied from Ono Sokki K.K.).

The above measurement of tensile strength and thickness is repeated for all the individual ink layers corresponding to the respective layers of a thermal transfer material. The tensile strength of the total ink layer is calculated by summing the above-measured tensile strengths of the individual ink layers weighted by the thickness of each layer in the thermal transfer material to provide a strength per unit sectional area.

Instead of forming and measuring individual ink layer samples corresponding to the layers of a thermal transfer material as described above, the tensile strength of a total ink layer can be measured as follows. Respective ink layers of a thermal transfer material are formed on a release paper as laminated layers having thickness ratios in the thermal transfer material but providing a total thickness of about 50 μm and dried to provide a laminated ink sample. The tensile strength of the laminated sample is measured in the same manner as described above to provide the tensile strength of the total ink layer of the thermal transfer material in terms of a strength per unit sectional area. The tensile strength measured in this way coincides with the value obtained through formation of the individual ink layers in the manner as described above.

The first and second ink layers of the thermal transfer material according to the present invention are required to satisfy a specific relationship with respect to the adhesions $F_1$ and $F_2$ and also to provide a tensile strength of the total ink layer in the range of 8–20 kg/cm$^2$ as described above. However, it is preferred that the respective ink layers satisfy the following conditions.

Figure 3A:
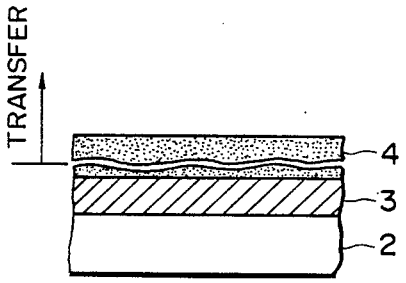
FIGS. 3A, 3B and 7 are schematic sectional views each showing an appearance of transfer with respect to the thermal transfer material according to the present invention.

In order to realize selective transfer of the second ink layer 4 ($F_1 > F_2$), it is preferred that the cohesion (strength) of the second ink layer 4 is smaller than that of the first ink layer and the adhesion ($F_1$) between the first ink layer 3 and the support 2 at a higher temperature. If this is satisfied, the separation of the second ink layer 4 can be easily caused therein as shown in FIG. 3A so that only the second ink layer 4 is transferred to the recording medium.

As described above, between the first and second ink layers, it is preferred that the cohesion of the first ink layer is larger than that of the second ink layer at a higher temperature. As the difference in cohesion between the first and second ink layers becomes larger, a recorded image of clearer color can be obtained by selective transfer of the second ink layer with less mixing of the first ink. Further, in addition to a large difference in cohesion, it is preferred that the first and second ink layers are composed of different materials which are mutually insoluble. In order to satisfy the large cohesion difference and the mutual insolubility, it is for example desired that the binder constituting the first ink layer contains 50% or more of a resin as described hereinbelow and the binder constituting the second ink layer contains 50% or more of a wax as described below.

Figure 3B:
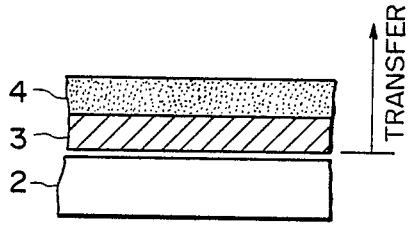
Figure 4:
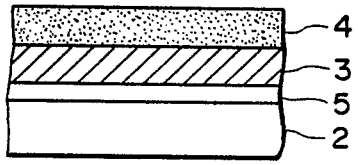
FIGS. 4 to 6 respectively show another laminar structure of the thermal transfer material according to the present invention.

In order to realize simultaneous transfer of the first and second ink layers as shown in FIG. 3B, it is preferred that the cohesion of the second ink layer 4 is larger than the adhesion ($F_1$) between the support 2 and the first ink layer 3. In this case, if the adhesion ($F_3$) between the recording medium and the second ink layer 4 is larger than the adhesion ($F_1$) between the support and the first ink layer 3, both the first ink layer 3 and the second ink layer 4 are transferred to the recording medium.

In order to realize the preferred adhesion and cohesion more easily, it is possible to provide a first adhesive layer 5 between the support 2 and the first ink layer 3. The adhesive layer 5 is a layer for controlling the adhesion ($F_1$) between the first ink layer and the support and is preferably disposed when it is difficult for the first ink layer to satisfy a larger cohesion than the second ink layer at a higher temperature and a small adhesion to the support at a lower temperature in combination. By providing such a first adhesive layer 5, it becomes possible to compose the first ink layer 3 of a material selected from a wide scope of materials so that it is advantageous in regulating the recorded image quality.

Figure 5:
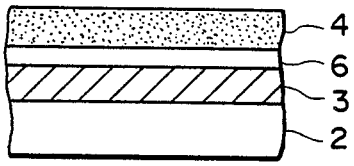

It is also possible to form a second adhesive layer 6 between the first ink layer 3 and the second ink layer 4 as shown in FIG. 5. The second adhesive layer 6 is a layer for controlling the adhesion ($F_2$) between the first and second ink layers. If the second adhesive layer 6 is composed of a material having properties similar to those required of the second ink layer 6 explained with reference to FIG. 1, the second ink layer is not necessarily required to satisfy the properties explained with reference to FIG. 1. As a result, it becomes possible to compose the second ink layer of a material which can show a large adhesion to the recording medium, e.g., a material similar to one for constituting the first ink layer in the embodiment shown in FIG. 1, thus being further advantageous in improving the recorded image quality.

Figure 6:
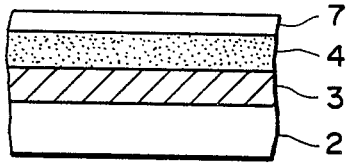

It is further possible to dispose a third adhesive layer 7 on the second ink layer 4 as a layer facing the recording medium as shown in FIG. 6. The third adhesive layer strengthens the adhesion of the second ink layer 4 to the recording medium. The second ink layer 4 generally contains a proportion of a colorant so that it is difficult to remarkably increase the adhesion of the second ink layer 4 to the recording medium. Accordingly, the provision of the third adhesive layer 7 is advantageous, especially when two-color recording is effected on a recording medium with poor surface smoothness.

It is also possible to provide two or more of the above-mentioned first adhesive layer 5, second adhesive layer 6 and third adhesive layer 7 in combination as desired.

By changing the above-explained laminar structure, it is possible to provide 8 ($=2^3$) types of laminar structures because of the presence or absence of the three adhesive layers. These laminar structures may be roughly divided into two types depending on the presence or absence of the second adhesive layer. More specifically, depending on whether or not the first ink layer 3 and the second ink layer 4 are contiguous with each other, the combination of materials constituting these ink layers (or adhesive layer) may change.

As described hereinbefore, in case where the first and second ink layers are disposed contiguous with each other, they are preferably composed of binders comprising materials which are mutually insoluble, and in view of the cohesions, it is desirable that the binder for the first ink layer and the binder for the second ink layer comprise at least 50% thereof of a resin and a wax, respectively. Further, it is possible to compose the first ink layer 3 of a material which does not soften. In the case where the first ink layer 3 and the second ink layer are contiguous to each other, it may be conceivable that the first ink layer 3 and the second ink layer 4 are separated at their boundary when they are separated at a higher temperature. However, it is hardly expectable that the boundary between the first and second ink layers under no heating is retained after patternwise heating so that it is difficult to completely separate the ink layers at their boundary. This mode of separation is therefore undesirable.

Figure 7:
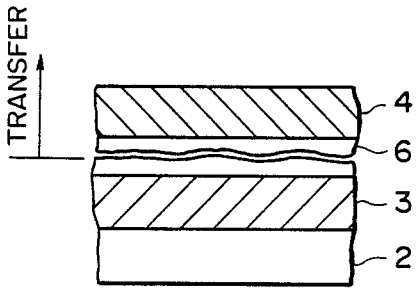

On the other hand, in case where the first ink layer 3 and the second ink layer 4 are not contiguous with each other, i.e., where the second adhesive layer 6 (FIG. 5) is provided, the constraint of desirably using a wax in the second ink layer 4 is removed. In this case, however, it is desirable that the second adhesive layer 6 contain 50% or more of a wax. More specifically, by adopting this arrangement, the second ink layer 4 is selectively transferred through breakage or separation within the second adhesive layer, as shown in FIG. 7, at the time of separation at a higher temperature. Accordingly, the structure shown in FIG. 5 is advantageous as compared with a structure not having a second adhesive layer 6, in that no separation is caused within the second ink layer 4 and therefore no fluctuation in density of recorded images results.

Hereinbelow, the structure or composition of the respective parts in the thermal transfer material 1 of the present invention is supplemented.

As the support 2 of the thermal transfer material, it is possible to use films of, e.g., polyester, aramide resin, nylon, polycarbonate, or paper such as capacitor paper, preferably having a thickness of about 3 to 12 μm. Too thick a support is not desirable because the heat conductivity becomes inferior. If a sufficient heat resistance and a strength are attained, a support can be thinner than 3 μm. It is sometimes advantageous to coat the back surface (opposite to the face on which the ink layers are disposed) with a layer for supplementing the heat resistance.

In the thermal transfer material 1 of the present invention, the ink layers and the adhesive layers, if any, on the support 2 may preferably have a thickness of not exceeding 10 μm in total. Further, it is preferred that each of the first ink layer 3, second ink layer 4, first adhesive layer 5, second adhesive layer 6 and third adhesive layer 7 has a thickness in the range of 0.5–5 μm.

As a heating means for the thermal transfer recording method using the thermal transfer material of the present invention, ordinary heat sources such as infrared rays and laser beam may also be used in place of a thermal head. Further, in order to provide a conduction heating system, i.e., a system wherein a thermal transfer material itself generates a heat due to a current passing therethrough, a thin layer of a conductive material such as aluminum may be disposed as a return electrode between the support 2 and the first ink layer 3 or the ink layer per se may be made conductive, as desired.

The first ink layer 3 constituting a thermal transfer layer on the support may be formed by dispersing a colorant of a first color tone in a binder (not intended to exclude a case where the colorant is dissolved in the binder), and the second ink layer 4 may be formed by dispersing a colorant of a second color tone in a binder.

In the thermal transfer material of the present invention, when the color of the first ink layer 3 and the second ink layer 4 are desired to be obtained substantially as they are, it is preferred to dipose a first ink layer 3 of a dark color such as black and a second ink layer 4 of a brighter color than that of the first ink layer such as red. Further, the first and second ink layers can be made in the same hue but different in density from each other, whereby two-color images with dense and pale portions can be obtained in the same manner as described above. Various two-color combinations can be obtained by using different kinds and concentrations of colorants and/or different proportions in thickness of ink layers.

The colorant may be selected from all of the known dyes and pigments including: carbon black, Nigrosin dyes, lamp black, Sudan Black SM, Alkali Blue, Fast Yellow G, Benzidine Yellow, Pigment Yellow, Indo Fast Orange, Irgadine Red, Paranitroaniline Red, Toluidine Red, Carmine FB, Permanent Bordeaux FRR, Pigment Orange R, Lithol Red 20, Lake Red C, Rhodamine FB, Rhodamine B Lake, Methyl Violet B Lake, Phthalocyanine Blue, Pigment Blue, Brilliant Green B, Phthalocyanine Green, Oil Yellow GG, Zapan Fast Yellow CGG, Kayaset Y963, Kayaset YG, Smiplast Yellow GG, Zapon Fast Orange RR, Oil Scarlet, Smiplast Orange G, Orasol Brown B, Zapon Fast Scarlet CG, Aizen Spiron Red BEH, Oil Pink OP, Victoria Blue F4R, Fastgen Blue 5007, Sudan Blue, and Oil Peacock Blue. Two or more of these colorant may be used in combination as desired. Further, metal powder such as copper powder and aluminum powder or powder or mineral such as mica may also be used as a colorant. Further, other additives such as surfactants, plasticizers, mineral oils, vegetable oils, fillers, etc., may also be added to an ink layer or adhesive layer.

The binders for constituting the first and second ink layers and the materials for constituting the first to third adhesive layers may be selected, as a single species or a combination of two or more species as desired, from the following materials: waxes including: natural waxes such as whale wax, beeswax, lanolin, carnauba wax, candelilla wax, montan wax and ceresin wax; petroleum waxes such as paraffin wax and microcrystalline wax; synthetic waxes such as oxidized wax, ester wax, low molecular weight polyethylene, Fischer-Tropsch wax and the like; higher fatty acids such as lauric acid, myristic acid, palmitic acid, stearic acid, and behenic acid; higher alcohols such as stearyl alcohol and behenyl alcohol; esters such as fatty acid esters of sucrose and fatty acid esters of sorbitane; amides such as oleic amide; or resins including: polyolefin resins, polyamide resins, polyester resins, epoxy resins, polyurethane resins, acrylic resins, polyvinyl chloride resins, cellulose resins, polyvinyl alcohol resins, petroleum resins, phenolic resins, polystyrene resins, polyvinyl acetate resins, natural rubber; elastomers such as natural rubber, styrene-butadiene rubber, isoprene rubber, chloroprene rubber; polyisobutylene, polybutene, etc.

The content of the colorant in each of the first and second ink layers may preferably be in the range of 1–90%, particularly 2–80%.

The ink layers and adhesive layers having the desired properties as described above may be obtained by appropriately controlling the properties such as molecular weights, crystallinities, etc., of the above mentioned materials or appropriately mixing a plurality of the above mentioned materials.

In the thermal transfer material of the present invention, however, as described hereinabove, it is important to exercise careful consideration on the physical properties such as softening temperature, melt viscosity and adhesion strength of the respective layers and the combination of the binder materials therein. In case where the first and second ink layers are contiguous to each other, it is preferred that the first ink layer contains 50 parts or more of a resin-type binder per 100 parts of the total binder and the second ink layer contains 50 parts or more of a wax-type binder per 100 parts of the total binder, among the binder materials as described above. On the other hand, in case where the first and second ink layers are not contiguous to each other, i.e., where the second adhesive layer is present therebetween, it is preferred that the first ink layer contains a resin-type binder and the second ink layer contains a wax-type binder respectively in a proportion of at least 50 parts per 100 parts of the total binder for each layer. Further, in case where a resin-type binder is also used in the second ink layer, the resin may preferably be different from that in the first ink layer. It is not necessary that a resin type ink consists only of a resin but is sufficient that a resin component is present in a proportion of 50 parts or more in 100 parts of the total binder. Likewise, it is sufficient that a wax-type into contains 50 parts or more of a wax component in 100 parts of the total binder.

The thermal transfer material used in the invention may be obtained by forming the respective layers by mixing the materials constituting the respective layers and an organic solvent such as methyl ethyl ketone, xylene and tetrahydrofuran capable of dissolving the binders and applying the thus formed coating liquids successively on the support. Alternatively, the so-called hot-melt coating method may be adopted, including the steps of blending, hot-melting and applying the materials in a molten state for the respective layers. The materials for the respective layers may be formed into aqueous emulsions by the addition of a dispersant such as a surfactant, and the aqueous emulsions may be applied to form the respective layers. Further, the respective layers of the transfer material may also be formed by using the above mentioned coating methods in combination, i.e., by using different methods for the respective layers.

Now, a method of two-color recording effected by using the thermal transfer material of the present invention will be explained.

Figure 8:
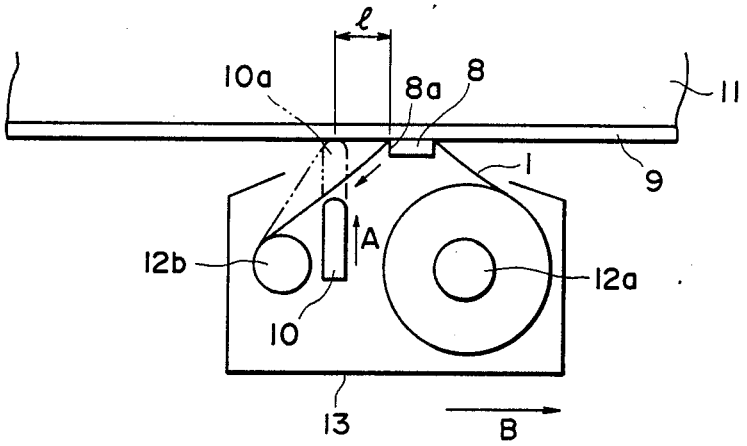
FIG. 8 is a view illustrating a thermal transfer recording apparatus for two-color recording and a mode of operation thereof using a thermal transfer material according to the present invention.

More specifically, a system as schematically shown in FIG. 8 may preferably be used. Referring to FIG. 8, a thermal transfer material 1 wound off from a supplying core 12*a* is moved to a heat-applying position, where it is pressed against a recording medium 9 supported by a platen 11 by means of a thermal head 8 so that the second ink layer thereof contacts the recording medium and simultaneously a pattern of heat is applied to the thermal transfer material 1 from the thermal head 8. If the thermal transfer material 1 is peeled from the recording medium 9 at the rear end 8*a* of the thermal head 8 immediately after the heat application, only the second ink layer is transferred to the recording medium 9 because $F_1 > F_2$. On the other hand, when a peeling-control member 10 is moved in the direction of an arrow A to a position 10*a* indicated by dashed lines, the thermal transfer material 1 and the recording medium are pressed against each other, a pattern of heat is supplied from the thermal head, and the thermal transfer material 1 is peeled from the recording medium 9 at the position 10*a* of the control member 10, both the first and second ink layers are transferred to the recording medium 9 because $F_1 < F_2$.

As described above, according to the present invention, there is provided a thermal transfer material which comprises at least a first and a second ink layer on a support and show specific relationships between the adhesion between the support and the first ink layer ($F_1$) and the adhesion between the first and second ink layers ($F_2$) at higher and lower temperatures.

By using the thermal transfer material of the present invention, it is possible to provide beautiful two-color images on a recording medium such as plain paper only by supplying a pattern of heat and separating the thermal transfer material from the recording medium while changing the length of time from the heat application until the separation.

Particularly, according to an embodiment of the thermal transfer material having an adhesive layer between the first and second ink layers, selective transfer of the second ink layer is promoted by separation in the adhesive layer so that the second ink layer can be transferred while retaining the layer state thereof. As a result, by using the thermal transfer material, beautiful two-color recorded images with little problem such as scratch of images even on a recording medium with poor surface smoothness. Further, according to an embodiment of thermal transfer material having an adhesive layer between the support and the first ink layer, it is possible to transfer the first ink layer while retaining its layer state on the second ink layer, so that it is possible to have the first ink layer show its hiding power effectively and also show its beautiful color tone.

Further, as the tensile strength of the total ink layers on the support of the thermal transfer material according to the present invention has been controlled to have a tensile strength of 8–20 kg/cm$^2$, a heat-applied portion and a non-heat-applied portion can be sharply cut at the boundary therebetween, so that thinning of recorded images can be obviated when both the first and second ink layers are transferred. As a result, a recorded image does not change in size or width because of change in color of the image.

Hereinbelow, the present invention will be explained more specifically while referring to specific examples of practice. Incidentally, the melt viscosity of a sample was measured by means of a rotational viscometer (E-type), and the number-average molecular weight Mn of a sample such as oxidized polyethylene was measured in the following manner.

[Molecular Weight Measurement]

The VPO method (Vapor Pressure Osmometry Method) is used. A sample of oxidized polyethylene is dissolved in a solvent such as benzene at various concentrations (C) in the range of 0.2 to 1.0 g/100 ml to prepare several solutions. The osmotic pressure ($\pi$/C) of each solution is measured and plotted versus the concentration to prepare a concentration (C)-osmotic pressure ($\pi$/C) curve, which is extrapolated to obtain the osmotic pressure at the infinite dilution $(\pi/C)_0$. From the equation of $(\pi/C)_0=RT/Mn$, the number-average molecular weight Mn of the sample is derived.

EXAMPLE 1

<Ink 1>

| | |
|---|---|
| Alkyl acrylates copolymer aqueous dispersion (Acronal YJ-8501D supplied from Mitsubishi Yuka Badische K.K., melt viscosity = $5 \times 10^4$ mPa.S at 150° C., average particle size ≠ 0.2 μm) | 60 parts |
| Carbon black aqueous dispersion | 40 parts |

(The amounts of aqueous dispersions for providing an ink formulation in this example and the other examples are all expressed based on their solid contents.)

The above components were sufficiently mixed to prepare an ink 1. The ink 1 was applied on a 6 μ-thick PET (polyethylene terephthalate) film and dried at 80° C. to form a 2.5 μ-thick first ink layer.

<Ink 2>

| | |
|---|---|
| Carbon wax aqueous dispersion (melt viscosity = $1 \times 10$ mPa.S at 130° C., average particle size = 0.5 μm) | 80 parts |
| Cyanine blue aqueous dispersion | 20 parts |

The above components were sufficiently mixed to prepare an ink 2, which was applied on the above prepared first ink layer and dried at 80° C. to form a 3 μm-thick second ink layer, whereby a thermal transfer material (I) having a structure as shown in FIG. 1 was obtained.

EXAMPLE 2

<Ink 3>

| | |
|---|---|
| Carnauba wax aqueous dispersion (melt viscosity = $1 \times 10$ mPa.S at 130° C., average particle size = 0.5 μm) | 100 parts |

<Ink 4>

| | |
|---|---|
| Oxidized polyethylene aqueous dispersion (Mn = 2000, melt viscosity = $2 \times 10^2$ mPa.S at 140° C., average particle size = 1 μm) | 60 parts |
| Ethylene-vinyl acetate resin aqueous dispersion (melt viscosity ≠ $2 \times 10^2$ mPa.S at 140° C., particle size = 0.5 μm) | 40 parts |
| Carbon black aqueous dispersion | 40 parts |
| Cyanine blue aqueous dispersion | 20 parts |

the above components were respectively sufficiently mixed to prepare inks 3 and 4. A first ink layer of the ink 1 was formed in the same manner as in Example 1. Then, the above ink 3 was applied on the first ink layer are dried at 80° C. to form a 1 μm-thick adhesive layer, and further a 2.5 μm-thick second ink layer was formed on the adhesive layer by the ink 4, whereby a thermal transfer material (II) having a laminar structure as shown in FIG. 5 was prepared.

The thermal transfer materials (I) and (II) were respectively superposed on wood-free paper having a surface smoothness of 200 sec so that their second ink layers contacted the paper. Then, heat in a pattern of solid black was applied to the transfer materials under the conditions of a pulse cycle of 1.4 msec., a pulse duration of 0.7 msec, and an applied energy of 13 mJ/mm$^2$, whereby the thermal transfer materials and the wood-free paper were heat-bonded. Each of the superposition of the thermal transfer material and the paper was loaded on a tensile tester (Tensilon RTM-100, mfd. by Toyo Boldwin K.K.) and the thermal transfer material was peeled from the wood-free paper at a peeling angle of 180° and a peeling speed of 300 mm/sec.

At 40° C. as a lower temperature in terms of the environmental temperature at the time of peeling, the heat-applied ink portions were transferred to the wood-free paper in both cases of using the thermal transfer materials (I) and (II), whereby solid black recorded images were obtained ($F_1<F_2$). On the other hand, at an environmental temperature of 90° C. as a higher temperature, clear blue recorded images were obtained through selective transfer of the second ink layers, and the first ink layers remained on the PET supports ($F_1>F_2$).

Samples for measurement of tensile strengths were separately prepared from the above inks 1 –4, and the tensile strengths of the total ink layers of the thermal transfer materials (I) and (II) were measured according the method described hereinbefore. The results are shown in Table 1 appearing hereinafter.

Then, the above thermal transfer materials (I) and (II) were respectively cut into a 6 mm-wide tapes and used for recording by means of a thermal transfer recording apparatus for an English typewriter (Typestar 6, mfd. by Canon K.K.). Referring to FIG. 8, as a thermal head 8, one prepared by Rohm K.K., having a length from the center of the heat generating part to the trailing end 8*a* (as shown in FIG. 2) of 350 μm was used. A carriage loading the thermal head 8 and an ink ribbon(thermal transfer material) 1 was moved in the direction of an arrow B, at a moving velocity of 50 mm/sec. As a result, the time from heating until the peeling-off of the ink ribbon from a recording medium was about 7 msec in the rapid peeling-off mode. In order to delay the time of the peeling, a control member 10 for controlling the peeling was disposed at about 5 mm (i.e., e=5 mm as shown in FIG. 8) after the trailing end 8*a* of the thermal head (i.e., downstream side of the trailing end 8*a* with respect to the moving direction of the thermal transfer material 1).

As a result, when the control member 10 was moved toward the recording medium, the delayed time of peeling-off was about 100 msec after the heating. Incidentally, it was confirmed that the result of the recording was not substantially different from the case of e=5 mm, even if the position of the control member was changed in the range of from 2 mm to 20 mm (i.e., e=2–20 mm) after the trailing end of the thermal head.

When the transfer recording was conducted on plain paper by the use of the thermal transfer materials (I) and (II) blue images were obtained if the transfer material was peeled rapidly and black images were obtained if the transfer material was peeled at the delayed time. The recorded images were evaluated by eye observation, the results are also shown in Table 1 appearing hereinafter.

COMPARATIVE EXAMPLE 1

<Ink 5>

| | |
|---|---|
| Acrylonitrile-alkyl acrylates copolymer aqueous dispersion (Acronal 81 DN, supplied from Mitsubishi Yuka Badische K.K., melt viscosity = $5 \times 10^4$ mPa.S at 150° C., average particle size = 0.2 μm) | 60 parts |
| Carbon black aqueous dispersion | 40 parts |

<Ink 6>

| | |
|---|---|
| Ethylene-vinyl acetate resin aqueous dispersion (melt viscosity = $6 \times 10^4$ mPa.S at 150° C., average particle size = 0.5 μm) | 80 parts |
| Cyanine blue aqueous dispersion | 20 parts |

The above components were respectively mixed sufficiently, to prepare inks 5 and 6. A 6 μm-thick PET support was first coated with the ink 5 to form a 2.5 μm-thick first ink layer and then with the ink 6 to form a 2.5 μm-thick second ink layer in the same manner as in Example 1, whereby a thermal transfer material (III) was prepared.

COMPARATIVE EXAMPLE 2

<Ink 7>

| | |
|---|---|
| Alkyl acrylates copolymer aqueous dispersion (the same as used in Example 1, melt viscosity = $5 \times 10^4$ mPa.S at 150° C., average particle size = 0.2 μm) | 10 parts |
| Carbon black aqueous dispersion | 90 parts |

The above components were sufficiently mixed to prepare an ink 7. A 6 μm-thick PET support was first coated with the ink 7 to form a 2.5 μm-thick first ink layer and then with the ink 2 used in Example 1 to form a 2.5 μm-thick second ink layer in the same manner as in Example 1, whereby a thermal transfer material (IV) was obtained.

Samples for measurement of tensile strengths were separately from the above inks 5, 7 and 2 used in Comparative Examples 1 and 2, and the tensile strengths of the total ink layers of the thermal transfer materials (III) and (IV) were measured according the method described hereinbefore. The results are also shown in Table 1.

Then, the thermal transfer materials (III) and (IV) were used for recording by means of the transfer recording apparatus in the same manner as the transfer materials (I) and (II). As a result, blue images were obtained in the rapid peeling mode and black images were obtained in the delayed peeling mode. The recorded images were evaluated by eye observation. The results are also shown in the following Table.

TABLE 1

| comparative | Thermal transfer material | Tensile strength (kg/cm$^2$) | Evaluation of images |
|---|---|---|---|
| Example 1 | I | 10 | ○ |
| 2 | II | 18 | ◎ |
| Comparative 1 | III | 45 | X-1 |
| Example 2 | IV | 7 | X-2 |

<Standards for evaluation of recorded images>

◎. . . Good.

○. . . Black color was slightly mixed in blue recorded images, but it was practically of no problem.

X-1 . . . Black images became thinner than the heat application pattern and edges were not clear.

X-2 . . . Lacking of black recorded images were observed and the lack portion remained on the support.

What is claimed is:

1. A thermal transfer material, comprising: a support and at least a first ink layer and a second ink layer disposed in the order named on the support, wherein said first and second ink layers are of different colors, and the adhesion strength $F_1$ between the support and the first ink layer and the adhesion strength $F_2$ between the first and second ink layers satisfy the relations of $F_1 > F_2$ at 90° C. and $F_1 < F_2$ at 40° C. the total ink layers on the support having a tensile strength in the range of 8–20 kg/cm$^2$.

2. A thermal transfer material according to claim 1, wherein the total ink layers on the support have a tensile strength in the range of 11–19 kg/cm$^2$.

3. A thermal transfer material according to claim 1, wherein the total ink layers on the support have a thickness in the range of 2 to 10 μm.

4. A thermal transfer material according to claim 1, which further comprises an adhesive layer between the support and the first ink layer.

5. A thermal transfer material according to claim 1, which further comprises an adhesive layer between the first and second ink layers.

6. A thermal transfer material according to claim 1, which further comprises an adhesive layer on the second ink layer.

7. A thermal transfer material according to claim 1, which further comprises an electroconductive layer between the support and the first ink layer.

* * * * *

UNITED STATES PATENT AND TRADEMARK OFFICE

CERTIFICATE OF CORRECTION

PATENT NO. : 4,960,632 Page 1 of 2

DATED : October 2, 1990

INVENTOR(S) : Koichi Tohma, et al.

It is certified that error appears in the above-identified patent and that said Letters Patent is hereby corrected as shown below:

Title Page:

[57] ABSTRACT:

Line 9, "having" should read --have--.

COLUMN 1:

Line 66, "dissolving" should read --solving--.

COLUMN 10:

Line 12, "dipose" should read --dispose--.

COLUMN 11:

Line 29, "case" should read --the case--.

Line 35, "wax-type into" should read --wax-type binder--.

UNITED STATES PATENT AND TRADEMARK OFFICE

CERTIFICATE OF CORRECTION

PATENT NO. : 4,960,632 Page 2 of 2

DATED : October 2, 1990

INVENTOR(S) : Koichi Tohma, et al.

It is certified that error appears in the above-identified patent and that said Letters Patent is hereby corrected as shown below:

COLUMN 13:

Line 55, "the" should read --The--.

Line 56, "A first ink layer" should begin a new paragraph.

COLUMN 15:

Line 45, according the" should read --according to the--.

Signed and Sealed this

Fifth Day of January, 1993

*Attest:*

DOUGLAS B. COMER

*Attesting Officer*

*Acting Commissioner of Patents and Trademarks*